United States Patent [19]

Szalay

[11] Patent Number: 4,783,883

[45] Date of Patent: Nov. 15, 1988

[54] LEVER ASSISTS FOR DOOR KNOBS

[76] Inventor: Alexander Szalay, 10 Rano St., Buffalo, N.Y. 14207

[21] Appl. No.: 9,912

[22] Filed: Feb. 2, 1987

[51] Int. Cl.[4] ..... B25G 3/28

[52] U.S. Cl. ..... 16/114 R; 16/115; 16/DIG. 30; 16/DIG. 40; 292/347; 292/DIG. 2

[58] Field of Search ..... 16/114 R, 115, 121, 16/DIG. 30, DIG. 40, DIG. 41; 74/544, 546, 557; 292/336.3, 347, DIG. 2; 403/233, 235; 350/242, 246, 251, 256

[56] References Cited

U.S. PATENT DOCUMENTS

| | | | |
|---|---|---|---|
| 1,483,745 | 2/1924 | Propson | 350/256 |
| 3,827,739 | 8/1974 | Overholser | 16/DIG. 30 X |
| 4,504,087 | 7/1985 | Pennington | 16/114 R X |

*Primary Examiner*—Fred A. Silverberg
*Attorney, Agent, or Firm*—Leon Gilden

[57] ABSTRACT

Several embodiments of levers are particularly adapted for attachment to door knobs. The levers provide for increased leverage to effect a more easy turning of a door knob to which they are attached.

1 Claim, 3 Drawing Sheets

LEVER ASSISTS FOR DOOR KNOBS

BACKGROUND OF THE INVENTION

1. Field of the Invention

The present invention relates to levers, and more particularly pertains to several embodiments of levers which are selectively attachable to door knobs to effect an easier turning thereof.

2. Description of the Prior Art

As can be appreciated, elderly and otherwise infirm persons quite frequently have difficultly in turning conventional door knobs. In many cases, it becomes necessary for such people to replace the door knobs and associated latching hardware due to their experienced difficulty in opening and closing a door. At present, there is apparently no commercially available items which could be easily attached to an existing door knob, whereby such door knob could be more easily leveraged during a turning operation. As such, there appears to be such a need for leverage increasing devices which can be attached to conventional door knobs, and in this respect, the present invention substantially fulfills this need.

SUMMARY OF THE INVENTION

In view of the foregoing disadvantages inherent in the known types of door knob assemblies now present in the prior art, the present invention provides for improved door knob assemblies by providing for several embodiments of leverage increasing devices which are attachable to conventional door knobs, thereby to permit the turning of such door knobs with substantially less physical effort. As such, the general purpose of the present invention, which will be described subsequently in greater detail, is to provide door knob leverage increasing devices which have all the advantages of prior art leverage increasing devices and none of the disadvantages.

To attain this, the present invention comprises several different embodiments of levers which may be selectively attached to conventional door knobs. A first embodiment is manufactured from plexiglass and is of a modern shape and design so as to be aesthetically pleasing. The lever includes a circular interior portion which is positionable over a door knob, with this interior portion being coated with rubber cement to effect a fixed securement of the lever to the knob. A threaded fastener is then utilized to tighten the lever around the door knob once it has been positioned thereover.

A second embodiment of the invention is manufactured from a continuous metallic strip which also includes a circular door knob receiving portion. The interior surface of the circular portion is coated with an adhesive so as to effect an initial attachment of the lever to a door knob, and a threaded fastener may then be utilized to securely clamp the entire lever assembly around the knob.

A third embodiment of the invention is manufactured from a strip of flexible rubber which has its two free ends positionable within a rigid conduit that serves as a handle. By positioning the free ends of the rubber strip within the conduit, a loop is formed that may then be stretch fitted around a conventional door knob. Once the free ends of the strip have been pulled to a desired tightness through the conduit, whereby the circular loop is securely fastened around the knob, they may be clipped off so as to provide an aesthetically pleasing appearance within the handle. A wedge may be inserted within the conduit between the rubber strip to effectively prevent the conduit from sliding off the rubber strip and to also prevent a loosening of the loop around the knob.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is meaured by the claims, nor is it intended to be limiting as to the scope of the invention in any way.

It is therefore an object of the present invention to provide a new and improved leverage device which has all the advantages of the prior art leverage devices and none of the disadvantages.

It is another object of the present invention to provide a new and improved leverage device which may be easily and efficiently manufactured and marketed.

It is a further object of the present invention to provide a new and improved leverage device which is of a durable and reliable construction.

An even further object of the present invention is to provide a new and improved leverage device which is susceptible of a low cost of manufacture with regard to both materials and labor, and which accordingly is then susceptible of low prices of sale to the consuming public, thereby making such leverage devices economically available to the buying public.

Still yet another object of the present invention is to provide a new and improved leverage device which provides in the apparatuses and methods of the prior art some of the advantages thereof, while simultaneously overcoming some of the disadvantages normally associated therewith.

Still another object of the present invention is to provide a new and improved leverage device which is particularly adapted for attachment around a conventional door knob.

Yet another object of the present invention is to provide several embodiments of leverage devices which can be easily and efficiently attached around door knobs to effectively lessen the amount of physical effort required to turn such knobs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
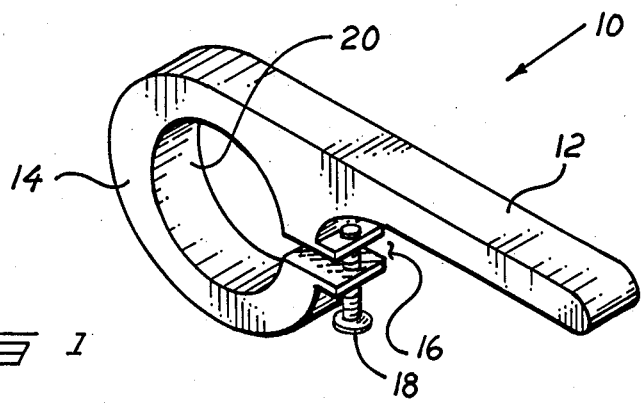
FIG. 1 is a perspective view of a first embodiment of the door knob lever comprising the present invention.
Figure 2:
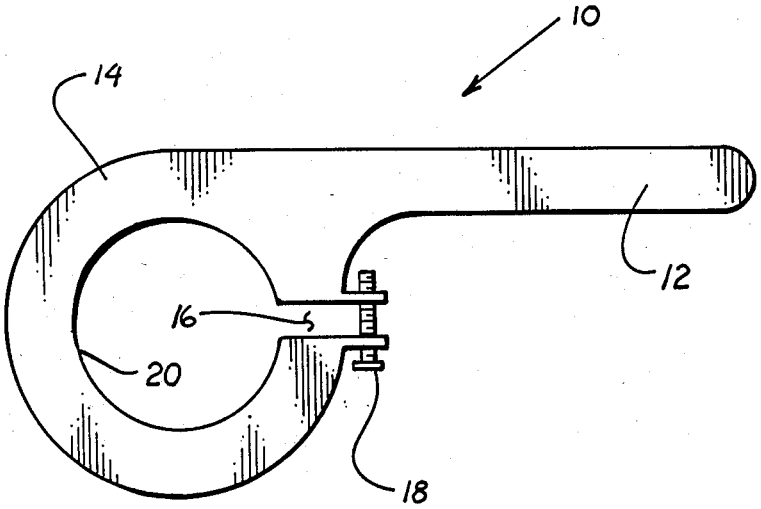
FIG. 2 is a front elevation view of the first embodiment.

With reference now to the drawings, and in particular to FIGS. 1 and 2 thereof, a first embodiment of a new and improved leverage device for door knobs embodying the principles and concepts of the present invention and generally designated by the reference numeral 10 will be described.

More specifically, it will be noted that the door knob lever 10 essentialy comprises a handle portion 12 that includes an integrally formed circular loop 14 which is positionable over a conventional door knob. The loop 14 is discontinuous so as to have a gap 16 formed within its periphery, and a threaded fastener 18 is positioned across the gap. A rotatable movement of the threaded fastener 18 will result in a closing or opening of the gap 16, as desired, to effect a secure positioning and tightening of the lever 10 over a conventional door knob. An interior surface 20 of the loop 14 may be coated with a rubber adhesive or some other abrasive or friction increasing material to aid in the attachment of the lever 10 to a door knob, while the entire assembly will desirably be manufactured from an aesthetically pleasing and strong material, such as plexiglass or the like.

Figure 3:
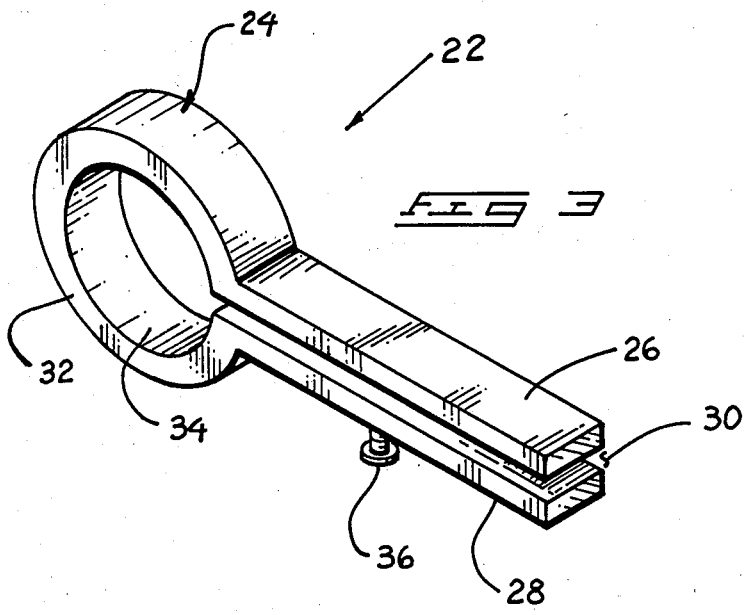
FIG. 3 is a perspective view of a second embodiment of door knob lever comprising the present invention.
Figure 4:
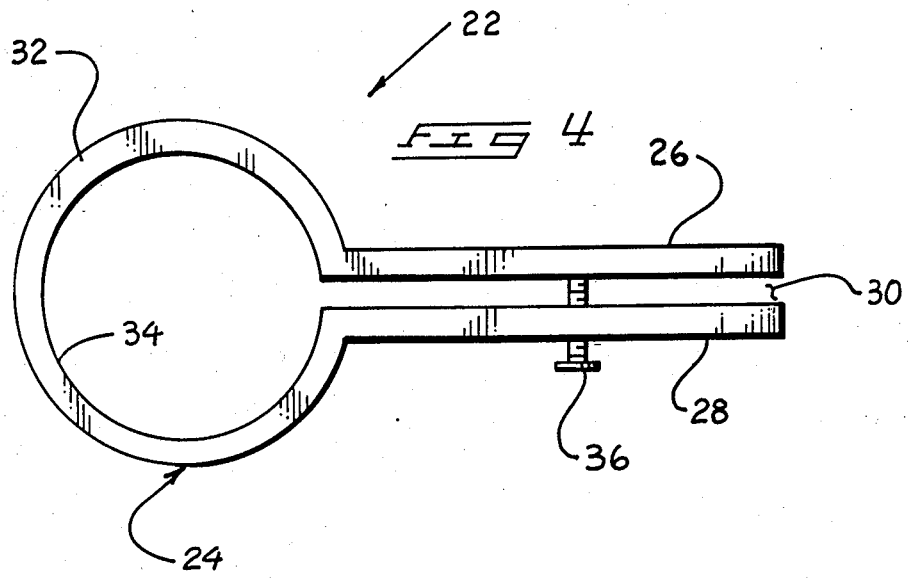
FIG. 4 is a front elevation view of the second embodiment of the invention.

FIGS. 3 and 4 illustrate a second embodiment of the invention which is generally designated by the reference numeral 22. The door knob lever 22 essentially comprises a continuous metal strap 24 having two free ends 26, 28 which are paralleledly aligned and which are spaced apart to define a gap 30. An intermediate portion of the metal strap 24 is formed into a circular loop 32 so as to define a section positionable over a conventional door knob and then interior surface 34 of the loop may be covered with a rubber adhesive or the like to increase the gripping properties thereof. As illustrated, a threaded fastener 36 is directed between the ends 26, 28, whereby a rotatable movement of the fastener will effect a change in the width of the gap 30, thus to control a clamping action around a conventional door knob.

Figure 5:
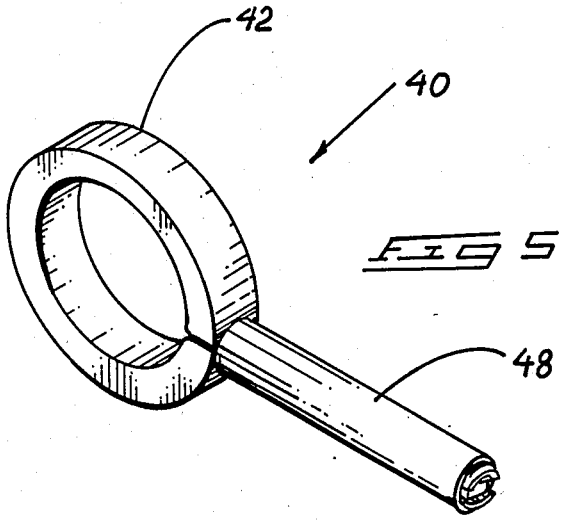
FIG. 5 is a perspective view of a third embodiment of door knob lever utilizable in the combination of the present invention.
Figure 6:
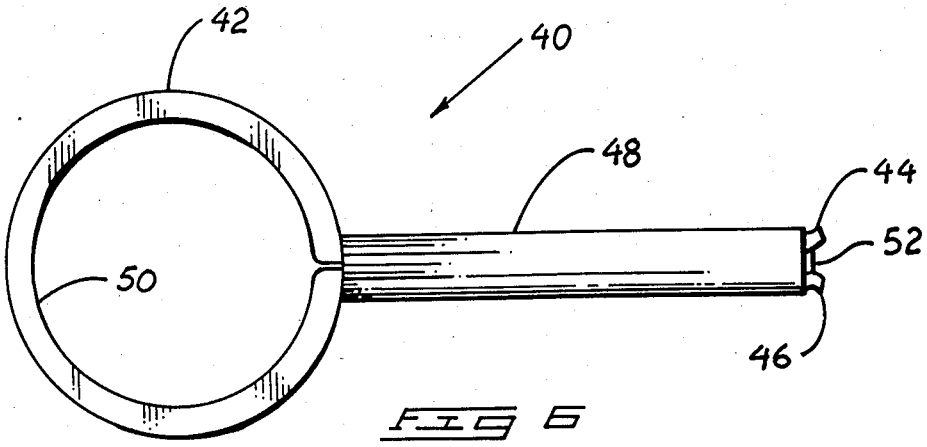
FIG. 6 is a front elevation view of the third embodiment.

FIGS. 5 and 6 of the drawings illustrate a third and final embodiment of the invention which is generally designated by the reference numeral 40. The door knob lever 40 essentially comprises a continuous strip of flexible rubber 42 which may be selectively wrapped around a conventional door knob. The two free ends 44, 46 of the rubber strap 42 may be directed through a rigid conduit 48 which essentially forms a handle. The ends 44, 46 may be pulled through the conduit 84 until the strap loop 50 formed by this action effectively grips a conventional door knob in a very tight and secure manner. The ends 44, 46 may then be clipped off and a rigid wedge 52 may be inserted between the ends within the conduit 48, thereby to lock the ends securely in position. The wedge 52 thus prevents the rubber strap 42 from becoming frictionally disengaged from a door knob about which it is positioned.

As to the manner of usage and operation of the several embodiments of the invention, the same should be apparent from the above description. Accordingly, no further discussion relative to the manner of usage and operation of the invention will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the forgoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved leverage increasing device removably attachable to a conventional door knob, said leverage increasing device comprising:

clamp means positionable around said door knob;

handle means extending outwardly from and being attached to said clamp means wherein said handle means is integrally attached to said clamp means, and clamp means tightening means for effecting a secure tightening of said clamp means around said door knob after said clamp means has been positioned thereover, and said clamp means comprises a strip of flexible rubber, and said handle means comprises a length of rigid conduit, said strip of flexible rubber having its free ends positionable through an interior portion of said conduit, and said clamp means tightening means comprises pulling said free ends of said rubber strip through said conduit until said clamp means is fixedly secure around said door knob, said clamp means tightening means further including a separate wedge member positionable between said free ends within said conduit to prevent further relative movement between said free ends and said conduit and enable subsequent removal of said separate wedge member for removal of said conduit from said strip of flexible material to enable removal of said clamp means from around said door knob.

* * * * *